US008899584B2

(12) United States Patent
Kondo et al.

(10) Patent No.: US 8,899,584 B2
(45) Date of Patent: Dec. 2, 2014

(54) SHEET REVERSING DEVICE

(71) Applicants: Hayato Kondo, Ibaraki (JP); Naoki Ogawa, Ibaraki (JP)

(72) Inventors: Hayato Kondo, Ibaraki (JP); Naoki Ogawa, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 13/869,907

(22) Filed: Apr. 24, 2013

(65) Prior Publication Data

US 2013/0307212 A1 Nov. 21, 2013

(30) Foreign Application Priority Data

Apr. 25, 2012 (JP) ..... 2012-099554

(51) Int. Cl.

| | |
|---|---|
| ***B65H 29/54*** | (2006.01) |
| ***B41F 21/10*** | (2006.01) |
| ***B41J 3/60*** | (2006.01) |
| ***B65H 85/00*** | (2006.01) |
| ***B41J 13/22*** | (2006.01) |

(52) U.S. Cl.

CPC ..... *B65H 85/00* (2013.01); *B41F 21/108* (2013.01); *B41F 21/102* (2013.01); *B41J 3/60* (2013.01); *B41F 21/104* (2013.01); *B41J 13/223* (2013.01)

USPC ..... 271/308; 271/307; 271/310; 271/186; 101/230; 101/232

(58) Field of Classification Search

USPC ..... 271/72, 275, 277, 307, 308, 310, 311, 271/312, 313, 184, 185, 186; 101/230, 232

See application file for complete search history.

(56) References Cited

U.S. PATENT DOCUMENTS

| | | | | | |
|---|---|---|---|---|---|
| 3,992,993 | A | * | 11/1976 | Kuhn et al. | 101/409 |
| 4,165,689 | A | * | 8/1979 | Giuiuzza | 101/230 |
| 6,089,155 | A | * | 7/2000 | Kemmerer et al. | 101/183 |
| 6,089,156 | A | | 7/2000 | Stephan | |
| 6,089,157 | A | * | 7/2000 | Becker et al. | 101/230 |
| 6,254,094 | B1 | * | 7/2001 | Becker et al. | 271/309 |
| 6,401,610 | B1 | * | 6/2002 | Becker et al. | 101/232 |
| 6,438,352 | B1 | | 8/2002 | Landa et al. | |
| 6,619,201 | B1 | * | 9/2003 | Becker et al. | 101/230 |
| 6,691,611 | B2 | * | 2/2004 | Gorbing et al. | 101/230 |
| 6,739,252 | B2 | * | 5/2004 | Stephan et al. | 101/230 |
| 7,175,176 | B2 | * | 2/2007 | Becker | 271/276 |
| 7,328,899 | B2 | * | 2/2008 | Wulf et al. | 271/276 |
| 2012/0069114 | A1 | | 3/2012 | Kaneko et al. | |

FOREIGN PATENT DOCUMENTS

JP S58-219058 A 12/1983

* cited by examiner

*Primary Examiner* — Ernesto Suarez

(74) *Attorney, Agent, or Firm* — Blakely Sokoloff Taylor & Zafman

(57) ABSTRACT

A sheet reversing device including a first conveyance unit, second conveyance unit, third conveyance unit, and sheet pressing member. The first conveyance unit includes a first holder, and a support surface that supports the sheet, and conveys the sheet with an edge held by the first holder, and its entire surface supported by the support surface. The second conveyance unit includes second holders, which convey the sheet. The third conveyance unit is supported to be swingable between a reception position at which the third conveyance unit receives the sheet, and a transfer position at which the third conveyance unit transfers the sheet to the second conveyance unit. The third conveyance unit includes a third holder, and conveys the sheet held by the third holder. The sheet pressing member presses the sheet, transferred from the third conveyance unit to the first conveyance unit, against the first conveyance unit support surface.

3 Claims, 9 Drawing Sheets

SHEET REVERSING DEVICE

BACKGROUND OF THE INVENTION

The present invention relates to a sheet reversing device which turns a sheet.

Conventionally, as an example of a sheet reversing device which turns a sheet, a sheet reversing unit applied to a sheet-fed offset rotary printing press equipped with a reversing mechanism, which is capable of printing on one or both of the two surfaces of a sheet, has been proposed, as described in Japanese Patent Laid-Open No. 58-219058. Such a conventional reversing unit is interposed between first and second, adjacent printing units, and performs a selective reversing operation for a sheet to allow single-sided printing and double-sided printing on the sheet.

The conventional sheet-fed offset rotary printing press equipped with a reversing mechanism uses air blowing or suction to prevent the trailing edge of a sheet from fluttering in holding it by a reversing unit. However, this arrangement is complicated as it requires an air device formed by, for example, an air source, pipe, and nozzle for air discharge or suction. This arrangement also requires adjusting the air pressure in accordance with, for example, the material of a sheet, and therefore imposes a heavy burden on the operator. In this case, if the air pressure is not adjusted, the position at which the sheet is held by the reversing unit shifts to degrade the front and back registration accuracy, or the trailing edge of the sheet cannot be held to cause a conveyance failure. Such a problem is posed not only in the printing press but also in processing machines which process the sheet, such as a coating machine and inspection machine.

SUMMARY OF THE INVENTION

It is an object of the present invention to propose a sheet reversing device which can reliably turn a sheet with high accuracy despite its simple arrangement.

In order to achieve the above-mentioned object, according to the present invention, there is provided a sheet reversing device comprising a first conveyance unit which includes a first holder that holds one edge of a sheet, and a support surface that supports the sheet conveyed by the first holder, and conveys the sheet with one edge thereof held by the first holder, and an entire surface thereof supported by the support surface, a second conveyance unit which includes second holders that hold the one edge of the sheet, and conveys the sheet held by the second holders, a third conveyance unit which is supported to be swingable between a reception position at which the third conveyance unit receives the sheet from the first conveyance unit, and a transfer position at which the third conveyance unit transfers the sheet to the second conveyance unit, the third conveyance unit including a third holder that holds the other edge of the sheet conveyed by the first conveyance unit, and conveying the sheet held by the third holder, and a sheet pressing member which is provided in the third conveyance unit, and presses the sheet, transferred from the third conveyance unit to the first conveyance unit, against the support surface of the first conveyance unit.

According to the present invention, when the third holder of the third conveyance unit holds the trailing edge of the sheet conveyed while its leading edge is held by the first holder of the first conveyance unit, the trailing edge of the sheet is pressed by the pressing member. With this operation, the trailing edge of the sheet can be prevented from fluttering to transfer the sheet to the second conveyance unit while the trailing edge of the sheet is reliably held by the third holder.

DESCRIPTION OF THE PREFERRED EMBODIMENTS

The present invention will be described in detail below with reference to the accompanying drawings.

<Arrangement of Digital Printing Apparatus>

Figure 1:
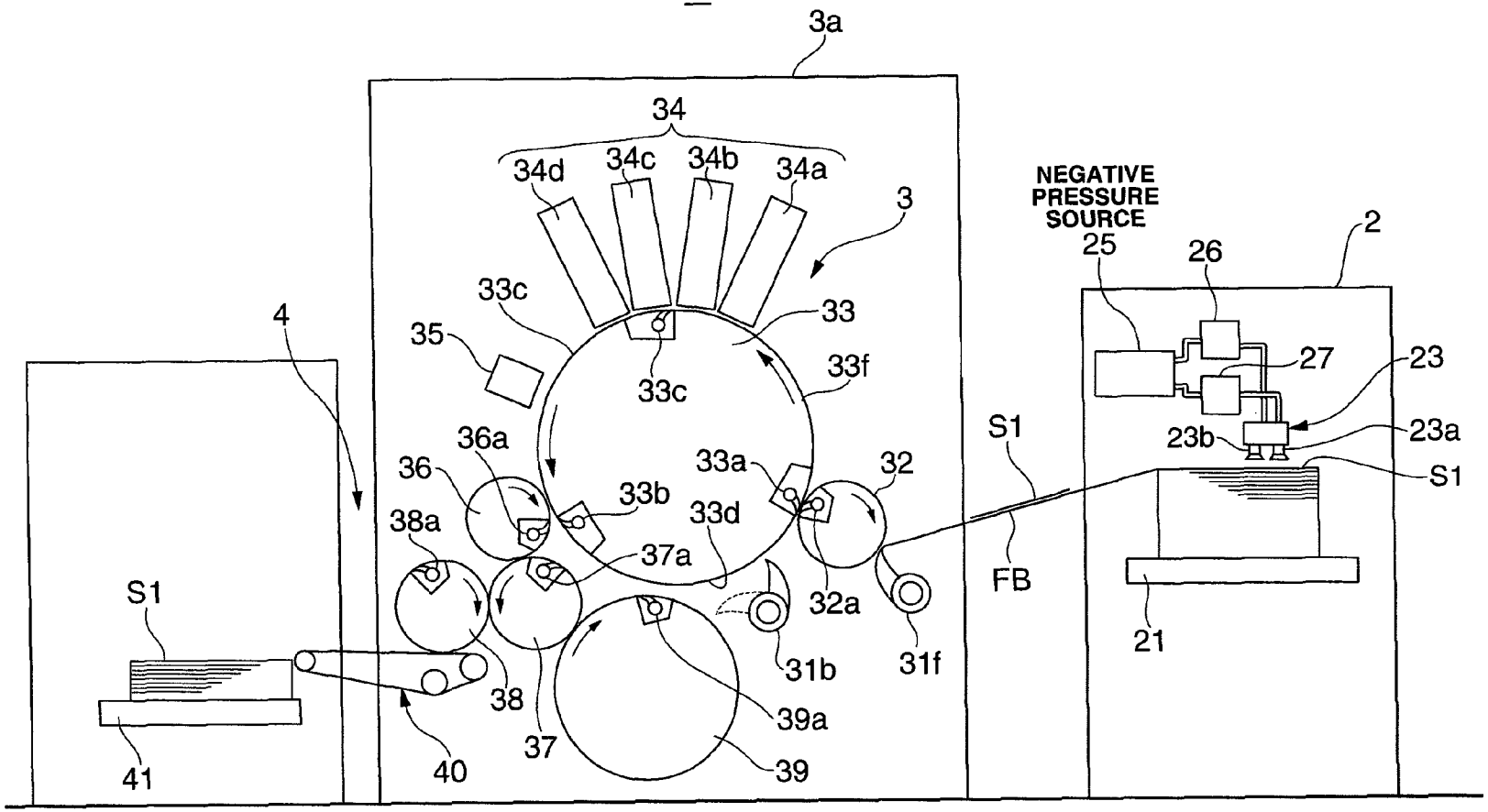
FIG. 1 is a side view showing the schematic arrangement of a digital printing apparatus to which a sheet reversing device according to the present invention is applied.

A digital printing apparatus 1 (sheet processing apparatus) according to this embodiment includes a sheet feed device 2 (sheet supply device), a digital printing unit 3 (processing unit), and a sheet delivery device 4 (sheet discharge device), as shown in FIG. 1.

The sheet feed device 2 includes a pile board 21 on which a plurality of sheets S1 are stacked, and a sucker device 23 which conveys the top sheet S1 on the pile board 21 onto a feeder board FB. The sucker device 23 includes a pair of suction ports 23*a* and 23*b*, which are connected to a negative pressure source 25 via a continuous supply valve 26 and an intermittent supply valve 27.

The continuous supply valve 26 and intermittent supply valve 27 enable/disable, at different timings, the suction operation of the suction ports 23*a* and 23*b* using a negative pressure from the negative pressure source 25.

A swing arm shaft pregripper 31*f* is disposed on the distal end side of the feeder board FB in the sheet conveyance direction. The swing arm shaft pregripper 31*f* is swingably supported on a frame 3*a* of the digital printing unit 3, and includes a gripper device (not shown) which grips and holds the leading edge (front edge) of the sheet S1 as its one edge. A feed-side transfer cylinder 32 is opposed to the swing arm shaft pregripper 31*f*, and rotatably supported on the frame 3*a*. A gripper device 32*a* which holds the leading edge of the sheet S1, transferred by a gripper device of the swing arm shaft pregripper 31*f*, in a gripped state is provided on the feed-side transfer cylinder 32. The swing arm shaft pregripper 31*f* and feed-side transfer cylinder 32 constitute an upstream sheet conveyance device. Note that in the following description, the gripper device is formed by a plurality of grippers aligned in the cylinder axis direction with predetermined gaps between them.

A printing cylinder 33 (second conveyance unit) as a second conveyance cylinder is disposed on the downstream side of the swing arm shaft pregripper 31*f* in the sheet conveyance direction to be in contact with the feed-side transfer cylinder 32. The printing cylinder 33 is rotatably supported on the frame 3*a*, and has a diameter three times that of the feed-side transfer cylinder 32. The printing cylinder 33 includes printing cylinder gripper devices 33*a*, 33*b*, and 33*c* which hold the leading edge of the sheet S1 upon receiving it from the gripper device 32*a* of the feed-side transfer cylinder 32, and support surfaces 33*d*, 33*e*, and 33*f* which are provided in correspondence with the printing cylinder gripper devices 33*a*, 33*b*, and 33*c*, and support the sheet S1. The printing cylinder 33 is implemented by a triple-diameter cylinder provided with three pairs of printing cylinder gripper devices 33*a*, 33*b*, and 33*c* and support surfaces 33*d*, 33*e*, and 33*f*. The printing cylinder gripper devices 33*a*, 33*b*, and 33*c* are provided at positions 120° out of phase with each other in the circumferential direction.

An inkjet nozzle portion 34 is opposed to the circumferential surface of the printing cylinder 33 on the downstream side of the contact portion of the printing cylinder 33 with the feed-side transfer cylinder 32 in the sheet conveyance direction.

The inkjet nozzle portion 34 includes a plurality of ink heads 34*a* to 34*d* (to be referred to as ink heads hereinafter) which are juxtaposed in the sheet conveyance direction along the circumferential surface of the printing cylinder 33, and store inks of different colors. Each of the ink heads 34*a* to 34*d* is oriented in a direction perpendicular to the circumferential surface of the printing cylinder 33. The ink heads 34*a* to 34*d* are arranged in proximity to the printing cylinder 33 to have small gaps with the sheet S1 having its entire surface sucked by the support surfaces 33*d*, 33*e*, and 33*f*. The printing cylinder 33 and inkjet nozzle portion 34 constitute a sheet printing device.

An ink drying lamp 35 is opposed to the printing cylinder 33 on the downstream side of a printing region 33K, printed by the inkjet nozzle portion 34 of the printing cylinder 33, in the sheet conveyance direction, and serves as a drying device which irradiates the sheet S1 with light such as infrared or ultraviolet rays to dry ink printed on the sheet S1. Note that drying includes applying thermal energy to the ink to evaporate the moisture of the ink, and curing the ink.

The printing cylinder 33 is arranged on the downstream side of the inkjet nozzle portion 34 in the sheet conveyance direction to be in contact with a delivery-side transfer cylinder 36 rotatably supported on the frame 3*a*. The delivery-side transfer cylinder 36 has a gripper device 36*a* which holds the leading edge of the sheet S1, conveyed by the printing cylinder 33, upon receiving it from the printing cylinder gripper devices 33*a*, 33*b*, and 33*c*.

Another delivery-side transfer cylinder 37 is arranged on the downstream side of the contact portion of the delivery-side transfer cylinder 36 with the printing cylinder 33 in the sheet conveyance direction to be in contact with the delivery-side transfer cylinder 36. The delivery-side transfer cylinder 37 is rotatably supported on the frame 3*a*. The delivery-side transfer cylinder 37 has a gripper device 37*a* (upstream gripper device) which receives and holds the leading edge of the sheet S1 conveyed by the delivery-side transfer cylinder 36.

A delivery cylinder 38 is arranged on the downstream side of the contact portion of the delivery-side transfer cylinder 37 with the delivery-side transfer cylinder 36 in the sheet conveyance direction to be in contact with the delivery-side transfer cylinder 37. The delivery cylinder 38 is rotatably supported on the frame 3*a*. The delivery cylinder 38 has a gripper device 38*a* (downstream gripper device) which receives and holds the leading edge of the sheet S1 conveyed by the delivery-side transfer cylinder 37.

A belt conveyor-shaped delivery belt 40 which conveys the sheet S1 is disposed below the delivery cylinder 38. A pile board 41 which stacks sheets S1 having undergone a digital printing process by the digital printing unit 3 is provided on the leading edge side of the delivery belt 40 in the sheet conveyance direction. The delivery cylinder 38, delivery belt 40, and pile board 41 constitute the sheet delivery device 4. Also, the path of the sheet S1 conveyed by the delivery cylinder 38 and delivery belt 40 constitutes a sheet discharge path.

A pre-reversal double-diameter cylinder 39 as a first conveyance cylinder (first conveyance unit) is arranged on the downstream side of the contact portion of the delivery-side transfer cylinder 37 with the delivery cylinder 38 in the sheet conveyance direction. The pre-reversal double-diameter cylinder 39 is rotatably supported on the frame 3*a*. The pre-reversal double-diameter cylinder 39 includes a gripper device 39*a* (first holder) which is implemented by a double-diameter cylinder with a diameter twice that of the delivery-side transfer cylinder 37, and receives and holds the leading edge of the sheet S1 conveyed by the delivery-side transfer cylinder 37. The pre-reversal double-diameter cylinder 39 also includes a circumferential surface 39*b* (support surface) which supports the entire surface of the sheet S1 with its leading edge held by the gripper device 39*a*.

Figure 2:
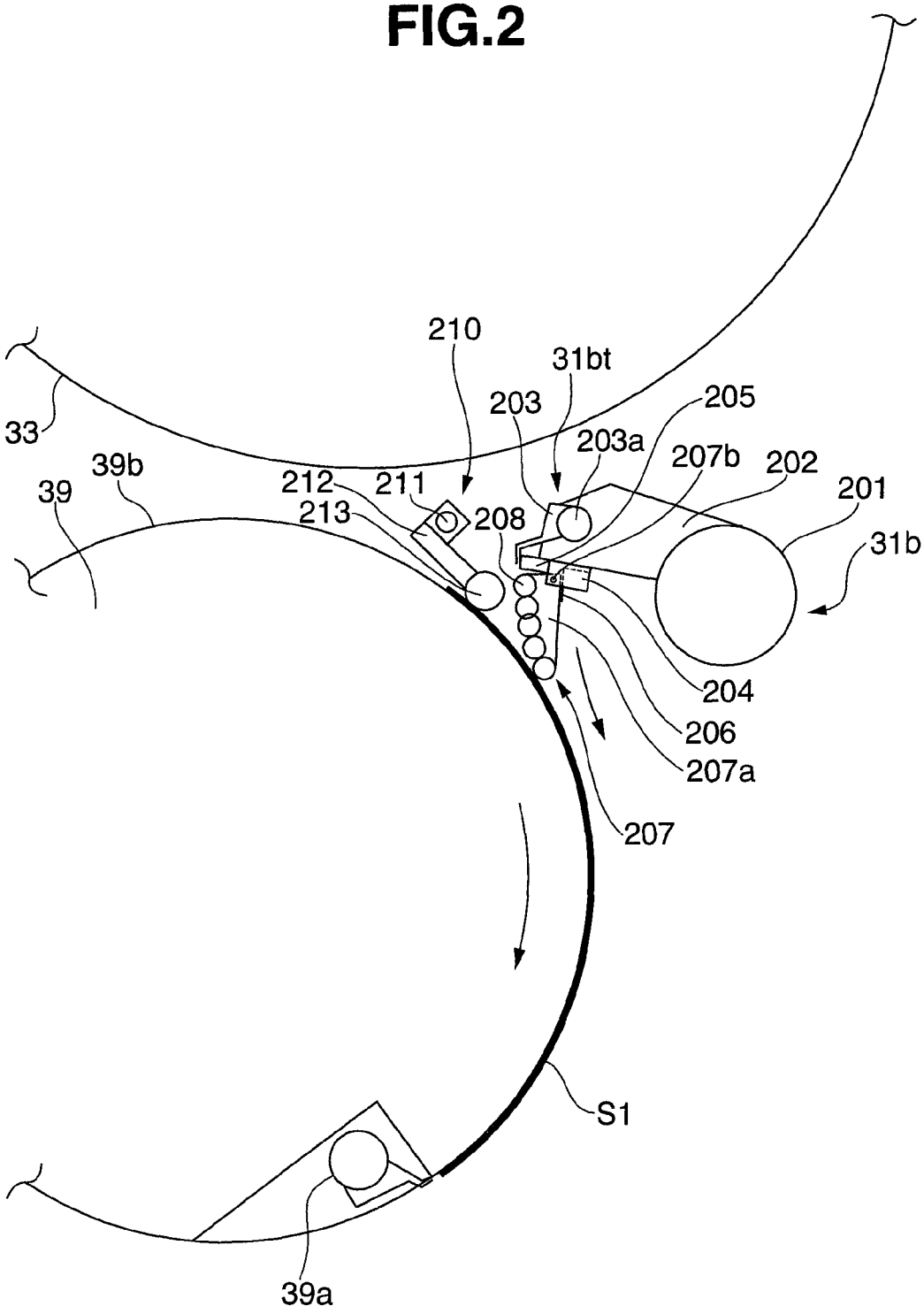
FIG. 2 is a side view of a sheet reversing device (reversing swing arm shaft pregripper and guide roller) which shows an embodiment of the present invention.

A reversing swing arm shaft pregripper 31*b* (third conveyance unit) having a reversing gripper device 31*bt* (third holder) which receives and holds the trailing edge (rear edge) of the sheet S1 as its other edge is opposed to the pre-reversal double-diameter cylinder 39 on the downstream side of the contact portion of the pre-reversal double-diameter cylinder 39 with the delivery-side transfer cylinder 37 in the sheet conveyance direction, as shown in FIG. 2.

The reversing swing arm shaft pregripper 31*b* is opposed to the printing cylinder 33 on the downstream side of the contact portion of the printing cylinder 33 with the delivery-side transfer cylinder 36 in the rotation direction of the printing cylinder 33, and on the upstream side of the contact portion of the printing cylinder 33 with the feed-side transfer cylinder 32 in the rotation direction of the printing cylinder 33. The reversing swing arm shaft pregripper 31*b* is supported on the frame 3*a* to be swingable between a reception position (a broken line in FIG. 1) at which it receives the trailing edge of the sheet S1 conveyed by the pre-reversal double-diameter cylinder 39, and a transfer position (a solid line in FIG. 1) at which it transfers by a gripping change the trailing edge of the sheet S1 to the printing cylinder gripper devices 33*a*, 33*b*, and 33*c* of the printing cylinder 33.

Note that the delivery-side transfer cylinders 36 and 37, pre-reversal double-diameter cylinder 39, and reversing swing arm shaft pregripper 31*b* constitute a sheet conveyance device 301 which conveys the sheet S1. The reversing gripper device and reversing swing arm shaft pregripper 31*b* constitute a sheet reversing unit which turns the sheet S1. The path of the sheet S1 conveyed by the delivery-side transfer cylinders 36 and 37, pre-reversal double-diameter cylinder 39, and reversing swing arm shaft pregripper 31*b* constitutes a sheet reversal path.

The operation of the gripper device 37*a* of the delivery-side transfer cylinder 37 is controlled so as to selectively transfer the sheet S1 to the gripper device 38*a* of the delivery cylinder 38, and the gripper device 39*a* of the pre-reversal double-diameter cylinder 39. Also, the operation of the gripper device 38*a* of the delivery cylinder 38 is controlled so as to selectively receive the leading edge of the sheet S1 conveyed by the delivery-side transfer cylinder 37.

<Arrangement of Reversing Swing Arm Shaft Pregripper>

A plurality of swing arms 202 are fixed to a reversing swing arm shaft 201, shown in FIG. 2, with predetermined gaps between them in the cylinder axis direction. The reversing swing arm shaft 201 is pivotally supported on the frame 3*a*. A swing arm gripper 203 is pivotally attached to the distal end of each of the plurality of swing arms 202 through a gripper shaft 203*a*.

A gripper pad 205 is provided at a position at which it is opposed to each swing arm gripper 203, and is attached to a gripper pad holding portion 204 fixed to the distal ends of the swing arms 202. A plurality of sets of swing arm grippers 203 and gripper pads 205 constitute the reversing gripper device 31*bt* (third holding unit) which grips and holds the trailing edge of the sheet S1. The reversing gripper device 31*bt*, swing arms 202, reversing swing arm shaft 201, and gripper pad holding portion 204 constitute the reversing swing arm shaft pregripper 31*b*.

The reversing swing arm shaft pregripper 31*b* is supported by the pivotal reversing swing arm shaft 201 to be swingable between a reception position (a broken line in FIG. 1) at which it receives the sheet S1 from the pre-reversal double-diameter cylinder 39, and a transfer position (a solid line in FIG. 1) at which it transfers by a gripping change the sheet S1 onto the printing cylinder 33.

A sheet trailing edge pressing member 207 (sheet pressing member) is attached to the distal end of the reversing swing arm shaft pregripper 31*b* to project from the pre-reversal double-diameter cylinder 39. The sheet trailing edge pressing member 207 presses the sheet S1, conveyed by the pre-reversal double-diameter cylinder 39, against the gripper device 39*a* (support surface) of the pre-reversal double-diameter cylinder 39. The sheet trailing edge pressing member 207 includes a holder 207*a* which has its proximal end pivotally supported through a pin 207*b*, and its free end extending toward the pre-reversal double-diameter cylinder 39, and a plurality of swing rollers 208 juxtaposed from the proximal to free ends of the holder 207*a* to be opposed to the pre-reversal double-diameter cylinder 39 of the holder 207*a*. The plurality of swing rollers 208 are arranged in an arc along the conveyance track of the sheet S1, which is determined by the swing operation of the reversing swing arm shaft pregripper 31*b*. The holder 207*a*, pin 207*b*, and swing rollers 208 constitute the sheet trailing edge pressing member 207.

Figure 3A:
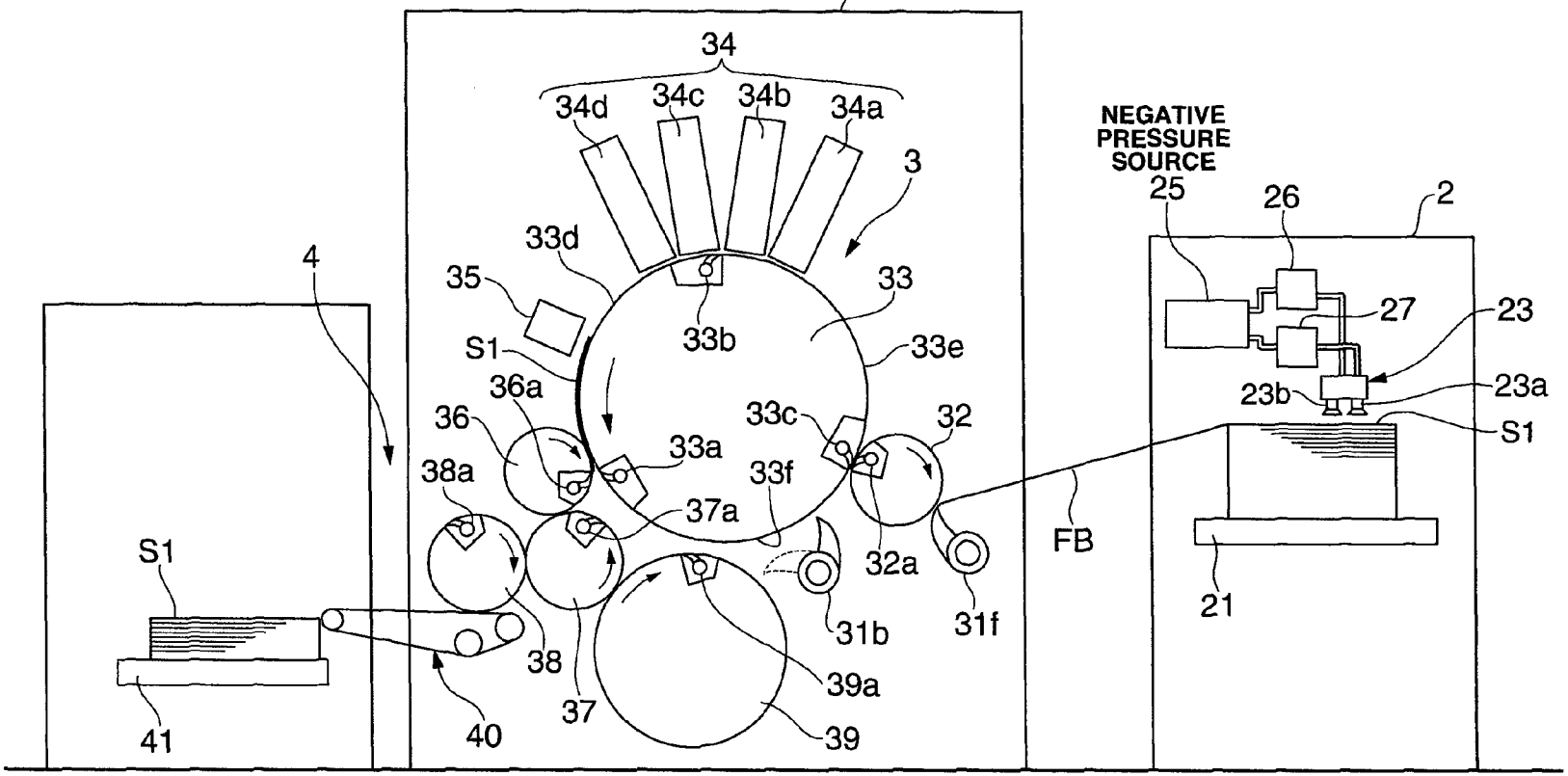
FIGS. 3A to 3E are side views showing double-sided printing processes (1) to (5) in the digital printing apparatus shown in FIG. 1.

A leaf spring 206 (biasing means) bent in a roughly L shape is attached to the gripper pad holding portion 204. The leaf spring 206 abuts against the holder 207*a*, and biases the holder 207*a* against the pre-reversal double-diameter cylinder 39. Note that for the sake of easy viewing of the leaf spring 206, FIG. 3A shows the leaf spring 206 in a state where it is separated from the holder 207*a* instead of in a state where it abuts against the holder 207*a*.

A guide roller portion 210 (upstream pressing member) is arranged on the upstream side of the reversing swing arm shaft pregripper 31*b* in the sheet conveyance direction to be adjacent to the gripper device 39*a* of the pre-reversal double-diameter cylinder 39. The guide roller portion 210 presses the sheet S1, conveyed by the pre-reversal double-diameter cylinder 39, against the gripper device 39*a* of the pre-reversal double-diameter cylinder 39. A plurality of guide roller portions 210 are fixed to a shaft 211, pivotally supported on the frame 3*a*, with predetermined gaps between them in the cylinder axis direction, and include a plurality of arms 212, and guide rollers 213 rotatably attached to the distal ends of the arms 212.

The arms 212 of the guide roller portion 210 are biased by the biasing force of a spring (not shown) in the direction in which the guide rollers 213 is always pressed against the circumferential surface 39*b* of the pre-reversal double-diameter cylinder 39. The shaft 211, arms 212, guide rollers 213, and spring (not shown) constitute the guide roller portion 210.

<Printing Operation of Digital Printing Apparatus>

The printing operation of the digital printing apparatus 1 configured as mentioned above will be described separately for the case wherein the single-sided printing mode is selected and that wherein the double-sided printing mode is selected.

When the single-sided printing mode is selected by operating a printing mode selection switch 80 by the operator, the continuous supply valve 26 is actuated. With this operation, the suction ports 23*a* and 23*b* suck the sheet S1 on the pile board 21, and convey it onto the feeder board FB, as shown in FIG. 1.

The continuous supply valve 26 opens every time the same number of sheets S1 as the numbers of printing cylinder gripper devices 33*a*, 33*b*, and 33*c* of the printing cylinder 33 are supplied during 360° rotation of the printing cylinder 33, that is, at each timing (period) at which the printing cylinder gripper devices 33*a*, 33*b*, and 33*c* in the printing cylinder 33, and the gripper device 32*a* of the feed-side transfer cylinder 32 are opposed to each other. As the continuous supply valve 26 opens, a negative pressure is supplied from the negative pressure source 25 to the suction ports 23*a* and 23*b* to perform suction. Supply of the sheet S1 so that all the printing cylinder gripper devices 33*a*, 33*b*, and 33*c* of the printing cylinder 33 grip the sheet S1 will be referred to as continuous sheet feed hereinafter. Also, the period at which the continuous supply valve 26 opens/closes in continuous sheet feed will be referred to as a first period hereinafter. With this operation, the sucker device 23 conveys the sheet S1 onto the feeder board FB at the first period.

The leading edge of the sheet S1 conveyed by the feeder board FB is held by the gripper device of the swing arm shaft pregripper 31*f*, and the sheet S1 is conveyed onto the feed-side transfer cylinder 32 upon a swing of the swing arm shaft pregripper 31*f*. The leading edge of the sheet S1 conveyed onto the feed-side transfer cylinder 32 is transferred by a gripping change to the gripper device 32*a* of the feed-side transfer cylinder 32.

The leading edge of the sheet S1 conveyed with rotation of the feed-side transfer cylinder 32 is transferred by a gripping change from the gripper device 32*a* of the feed-side transfer cylinder 32 to either of the printing cylinder gripper devices 33*a*, 33*b*, and 33*c* of the printing cylinder 33, and the sheet S1 is conveyed with rotation of the printing cylinder 33. In the printing cylinder 33, a suction force acts on the suction holes 33*g* on the downstream side in the rotation direction from a suction start position 33*i*, so the entire surface of the sheet S1 is sucked to and brought into tight contact with the support surfaces 33*d*, 33*e*, and 33*f* as the sheet S1 passes through the suction start position 33*i*.

A digital printing process is performed on the obverse surface of the sheet S1 conveyed by the printing cylinder 33 by discharging minute drops of ink from the ink heads 34*a* to 34*d* of the inkjet nozzle portion 34. The sheet S1 is in tight contact with the support surface of the printing cylinder 33, and is therefore conveyed while minute intervals with the ink heads 34*a* to 34*d* are maintained. Ink discharged while these minute intervals are maintained can be adhered to the sheet S1 with high accuracy, thereby allowing high-quality printing.

The ink on the sheet S1 printed by the inkjet nozzle portion 34 dries with light emitted by the ink drying lamp 35 when the sheet S1 passes between the printing cylinder 33 and the ink drying lamp 35. The sheet S1 is then conveyed onto the delivery-side transfer cylinder 36.

Figure 3B:
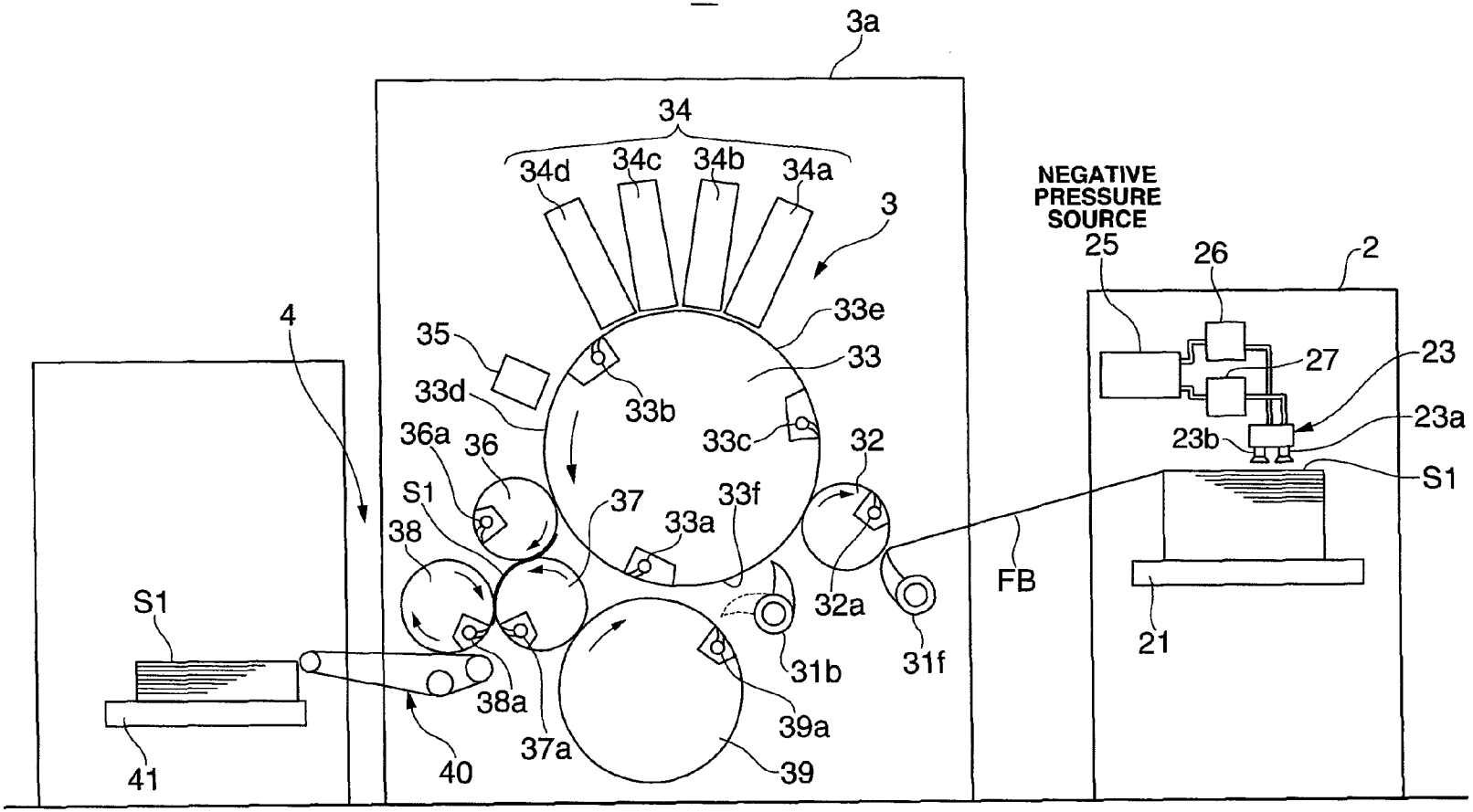

In the contact portion between the printing cylinder 33 and the delivery-side transfer cylinder 36, the leading edge of the sheet S1 is transferred by a gripping change from the printing cylinder gripper devices 33*a* to 33*c* of the printing cylinder 33 to the gripper device 36*a* of the delivery-side transfer cylinder 36, as shown in FIG. 3A. At this time, the leading edge of the sheet S1 passes through a suction end position 33*j*, so no suction force acts from the suction holes 33*g*. This makes it possible to easily peel the sheet S1 off the support surfaces 33*d*, 33*e*, and 33*f* to allow a smooth gripping change. Then, the leading edge of the sheet S1 held by the gripper device 36*a* of the delivery-side transfer cylinder 36 is transferred by a gripping change from the gripper device 36*a* of the delivery-side transfer cylinder 36 to the gripper device 37*a* of the delivery-side transfer cylinder 37 in the contact portion between the delivery-side transfer cylinders 36 and 37, as shown in FIG. 3B.

In the single-sided printing mode, a control device (not shown) controls a conveyance path switching device 82 to transfer all sheets S1 from the delivery-side transfer cylinder 37 onto the delivery cylinder 38 based on a phase signal from the rotary encoder 84. That is, in the phase in which the leading edge of the sheet S1 is positioned in the contact portion between the delivery-side transfer cylinders 37 and 38, the gripper device 37*a* of the delivery-side transfer cylinder 37 cancels holding of the leading edge of the sheet S1, and the gripper device 38*a* of the delivery cylinder 38 is held while gripping the leading edge of the sheet S1 at the same time. With this operation, the sheet S1 printed on its one surface is transferred from the delivery-side transfer cylinder 37 onto the delivery cylinder 38, and conveyed.

Holding, by the gripper device 38*a*, of the sheet S1 transferred onto the delivery cylinder 38 is canceled at the timing at which the gripper device 38*a* of the delivery cylinder 38 is positioned above the delivery belt 40, and is placed on the delivery belt 40.

The sheet S1 placed on the delivery belt 40 is conveyed as the delivery belt 40 travels, and the sheet S1 having undergone a digital printing process on its obverse surface is discharged onto the delivery belt 40 of the sheet delivery device 4.

On the other hand, when the double-sided printing mode is selected by the operation of the operator, the control device (not shown) actuates the intermittent supply valve 27. With this operation, the sheet S1 on the pile board 21 is sucked by the suction ports 23*a* and 23*b*, and conveyed onto the feeder board FB.

At this time, the intermittent supply valve 27 is controlled at the timing at which the sheets S1 are alternately supplied so as to open, close, open, close, . . . , at the timing of continuous supply, that is, the timing (period) at which the printing cylinder gripper devices 33*a*, 33*b*, and 33*c* of the printing cylinder 33, and the gripper device 32*a* of the feed-side transfer cylinder 32 are opposed to each other. This period is twice that of continuous supply. In this manner, supply of the sheet S1 so that the printing cylinder gripper devices 33*a*, 33*b*, and 33*c* of the printing cylinder 33 alternately grip the sheet S1 will be referred to as intermittent sheet feed hereinafter, and the period at which the intermittent supply valve 27 opens/closes in intermittent sheet feed will be referred to as a second period hereinafter. With this operation, the sucker device 23 conveys the sheet S1 onto the feeder board FB at the second period.

The sheet S1 fed onto the feeder board FB by the sucker device 23 is transferred onto the printing cylinder 33 through the swing arm shaft pregripper 31*f* and feed-side transfer cylinder 32 in the same way as in the single-sided printing mode. At this time, since the sheet S1 is fed at the timing of intermittent sheet feed, the printing cylinder gripper devices 33*a* to 33*c* of the printing cylinder 33 receive the sheet S1 alternately conveyed from the feed-side transfer cylinder 32.

The sheet S1 transferred onto the printing cylinder 33 is conveyed to the inkjet nozzle portion 34, and obverse surface printing is performed on one surface (obverse surface). Note that the control device (not shown) prints on the sheet S1 alternately held by the printing cylinder gripper devices 33*a* to 33*c* of the printing cylinder 33, based on a phase signal from the rotary encoder 84. On the other hand, the ink heads 34*a* to 34*d* of the inkjet nozzle portion 34 are controlled so as not to print on the support surfaces 33*d* to 33*f* corresponding to the printing cylinder gripper devices 33*a* to 33*c* which do not hold the sheet S1.

For double-sided printing, the control device (not shown) controls the conveyance path switching device 82 so that the sheet S1 printed on its obverse surface by the inkjet nozzle portion 34 is transferred onto the pre-reversal double-diameter cylinder 39 without transferring it from the delivery-side transfer cylinder 37 onto the delivery cylinder 38.

More specifically, in conveyance path switching control, in the phase in which the sheet S1 which is printed on its obverse surface and has undergone no digital print process on its other surface (reverse surface) is positioned in the contact portion between the delivery-side transfer cylinder 37 and the delivery cylinder 38, the grippers of the gripper device 37*a* of the delivery-side transfer cylinder 37 are kept closed without opening to maintain the state in which the gripper device 37*a* holds the leading edge of the sheet S1. At this time, the grippers of the gripper device 38*a* of the delivery cylinder 38 are kept open without closing.

With this operation, the sheet S1 printed only on its obverse surface continues to be conveyed by the delivery-side transfer cylinder 37 without a gripping change to the delivery cylinder 38.

Figure 3C:
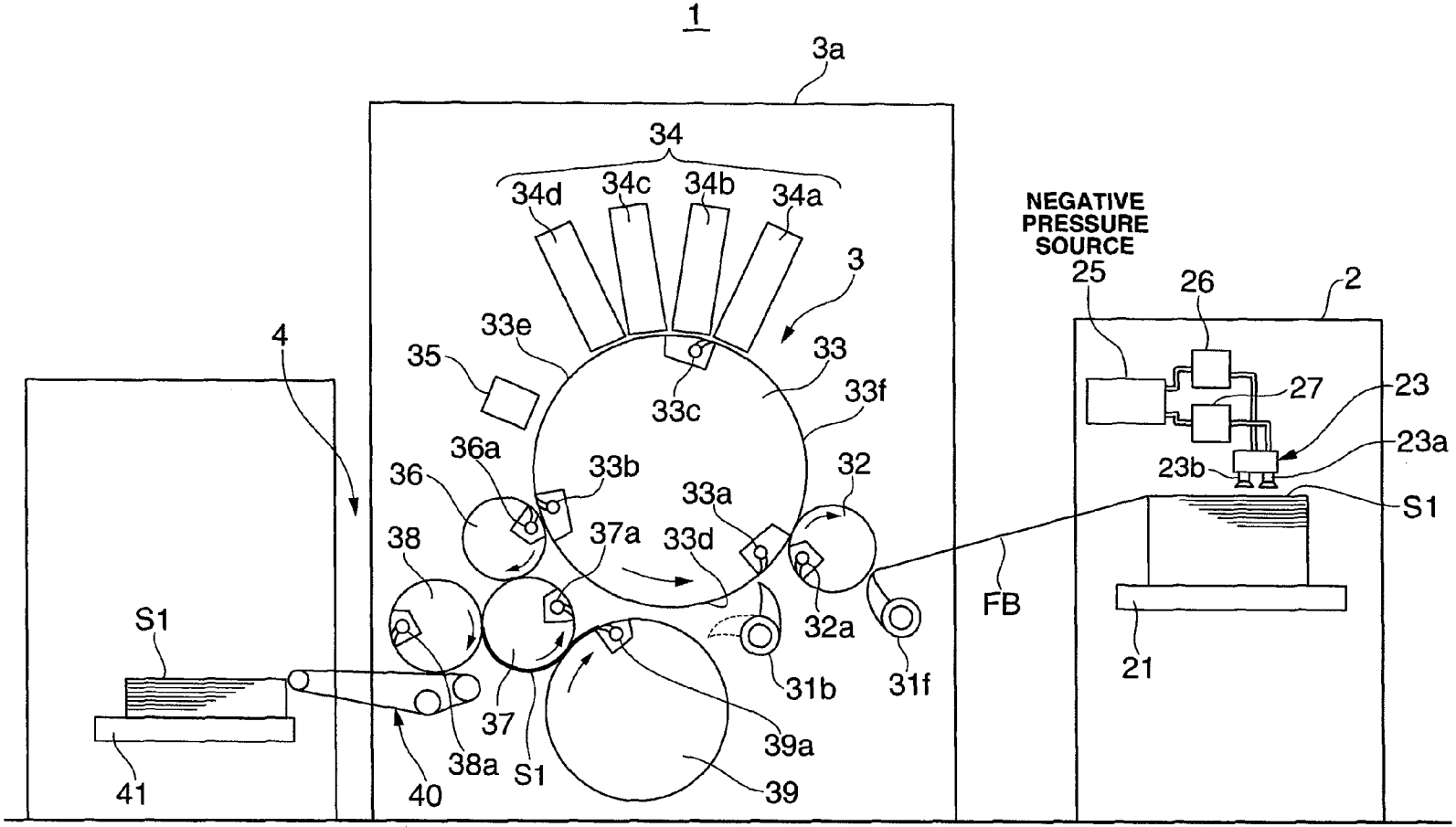

The leading edge of the sheet S1 conveyed by the delivery-side transfer cylinder 37 is held by closing the grippers of the gripper device 39*a* of the pre-reversal double-diameter cylinder 39 in the contact portion between the delivery-side transfer cylinder 37 and the pre-reversal double-diameter cylinder 39. At the same time, holding of the leading edge of the sheet S1 is canceled by opening the grippers of the gripper device 37*a* of the delivery-side transfer cylinder 37. With this operation, the leading edge of the sheet S1 is transferred by a gripping change from the gripper device 37*a* of the delivery-side transfer cylinder 37 to the gripper device 39*a* of the pre-reversal double-diameter cylinder 39, as shown in FIG. 3C.

The sheet S1 held by the gripper device 39*a* of the pre-reversal double-diameter cylinder 39 is conveyed with rotation of the pre-reversal double-diameter cylinder 39, as shown in FIG. 2. During this time, the sheet S1 is kept pressed against the circumferential surface 39*b* of the pre-reversal double-diameter cylinder 39 from its leading to trailing edges by the guide rollers 213 of the guide roller portion 210 provided on the upstream side of the sheet trailing edge pressing member 207 of the reversing swing arm shaft pregripper 31*b* in the sheet conveyance direction. That is, before the trailing edge of the sheet S1 conveyed by the pre-reversal double-diameter cylinder 39 is transferred by a gripping change to the reversing gripper device 31*bt* of the reversing swing arm shaft pregripper 31*b*, the sheet S1 is perfectly prevented from fluttering to maintain the state in which the entire surface of the sheet S1 is pressed against, that is, in tight contact with the circumferential surface 39*b* (support surface) of the pre-reversal double-diameter cylinder 39.

Before the trailing edge of the sheet S1 pressed against the circumferential surface 39*b* of the pre-reversal double-diameter cylinder 39 passes through the guide rollers 213 of the guide roller portion 210, the reversing swing arm shaft pregripper 31*b* swings to the reception position. With this operation, the trailing edge of the sheet S1 is pressed against the circumferential surface 39*b* of the pre-reversal double-diameter cylinder 39 by the plurality of swing rollers 208 of the sheet trailing edge pressing member 207.

Immediately before the trailing edge of the sheet S1 passes through the guide rollers 213 of the guide roller portion 210, the sheet S1 is pressed against the circumferential surface 39*b* of the pre-reversal double-diameter cylinder 39 by the guide rollers 213 and swing rollers 208. Then, even after the trailing edge of the sheet S1 conveyed with rotation of the pre-reversal double-diameter cylinder 39 passes through the guide rollers 213 of the guide roller portion 210, the trailing edge of the sheet S1 continues to be pressed against the circumferential surface 39*b* of the pre-reversal double-diameter cylinder 39 by the swing rollers 208.

With this operation, until the gripping change timing at which the swing arm grippers 203 of the reversing swing arm shaft pregripper 31*b* and the trailing edge of the sheet S1 are opposed to each other, the trailing edge of the sheet S1 is kept in tight contact with the circumferential surface 39*b* of the pre-reversal double-diameter cylinder 39. This perfectly prevents the sheet S1 from fluttering, that is, floating or separating from the circumferential surface 39*b* of the pre-reversal double-diameter cylinder 39. This also prevents the sheet S1 from shifting with respect to the pre-reversal double-diameter cylinder 39.

Figure 3D:
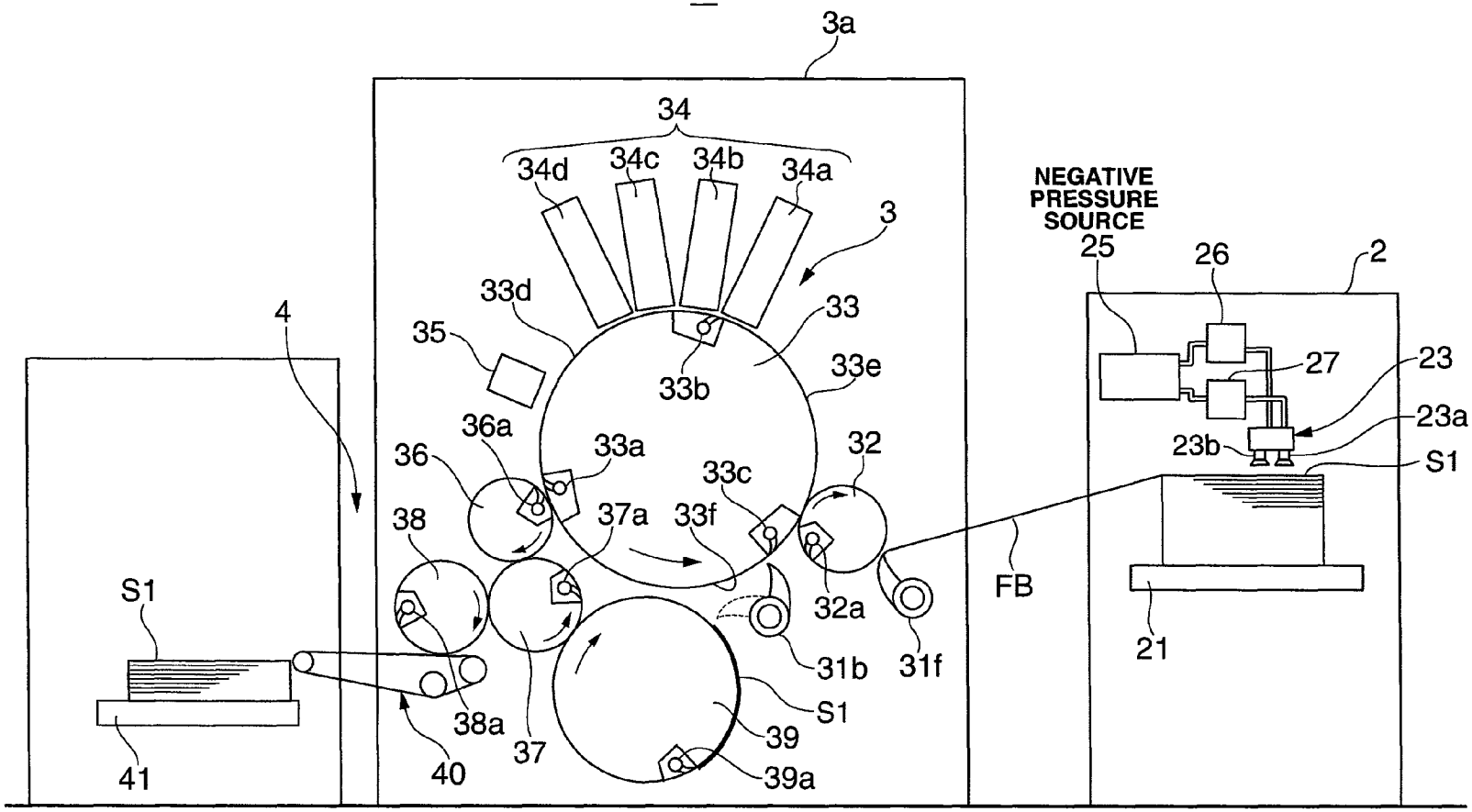
Figure 4:
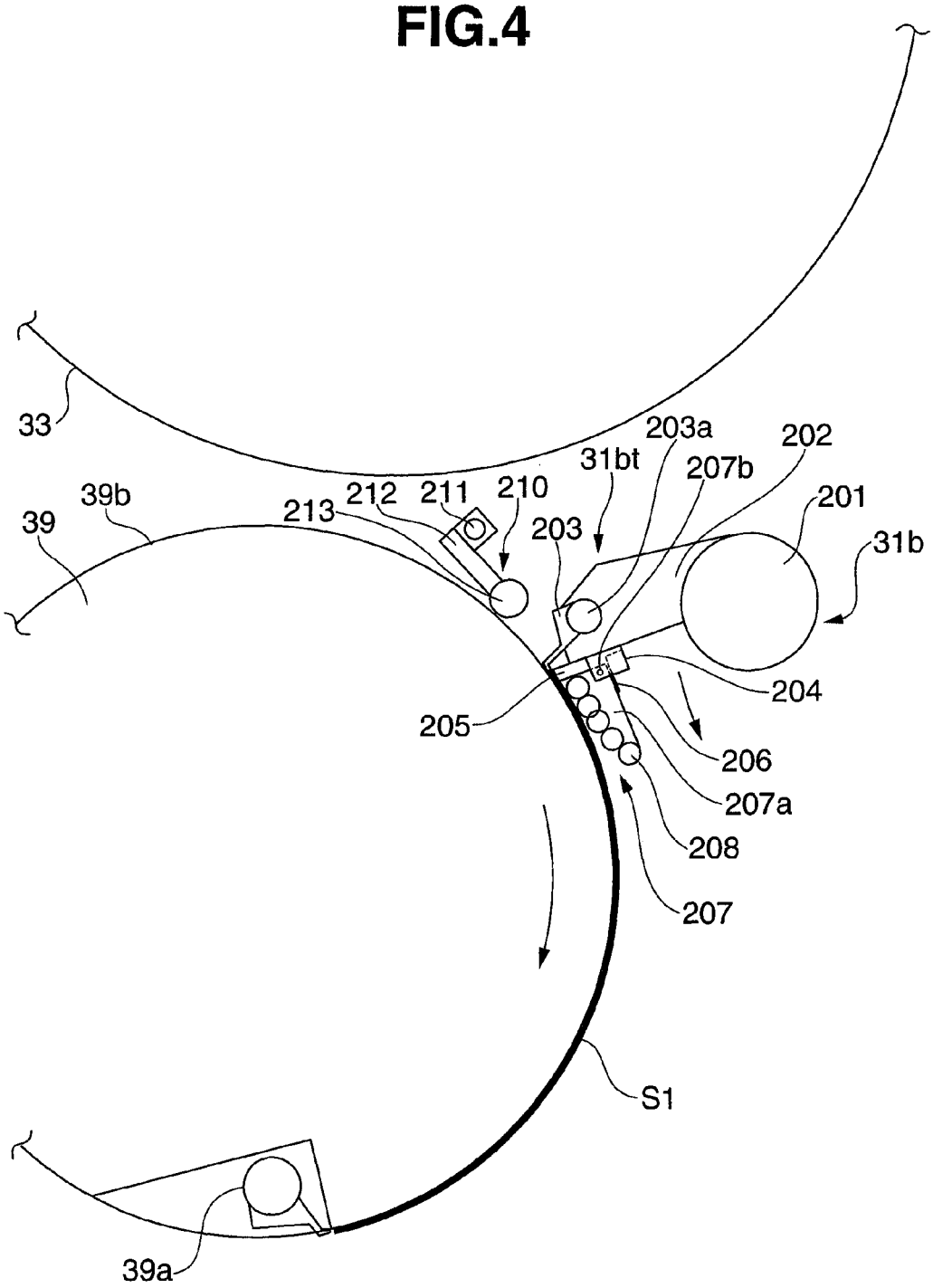
FIG. 4 is a side view showing how the trailing edge of a sheet is held by the reversing swing arm shaft pregripper shown in FIG. 2.

As shown in FIG. 3D, when the trailing edge of the sheet S1 and the swing arm grippers 203 of the reversing gripper device 31*bt* are opposed to each other, the sheet S1 is clamped and gripped between the swing arm grippers 203 and the gripper pads 205, as shown in FIG. 4. With this operation, the sheet S1 is held by the reversing swing arm shaft pregripper 31*b*. At the same time, holding of the sheet S1 by the gripper device 39*a* of the pre-reversal double-diameter cylinder 39 is canceled.

Figure 3E:
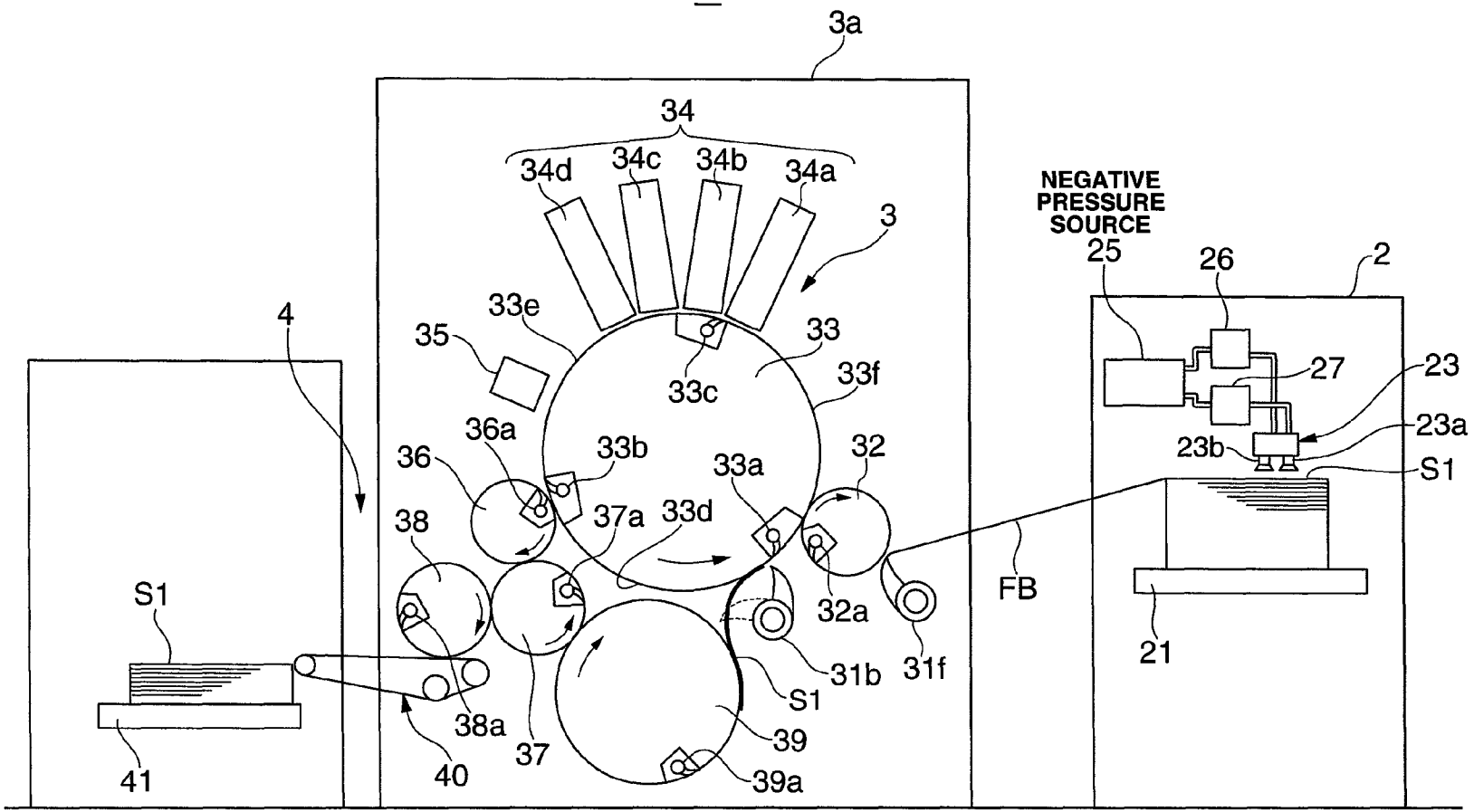
Figure 5:
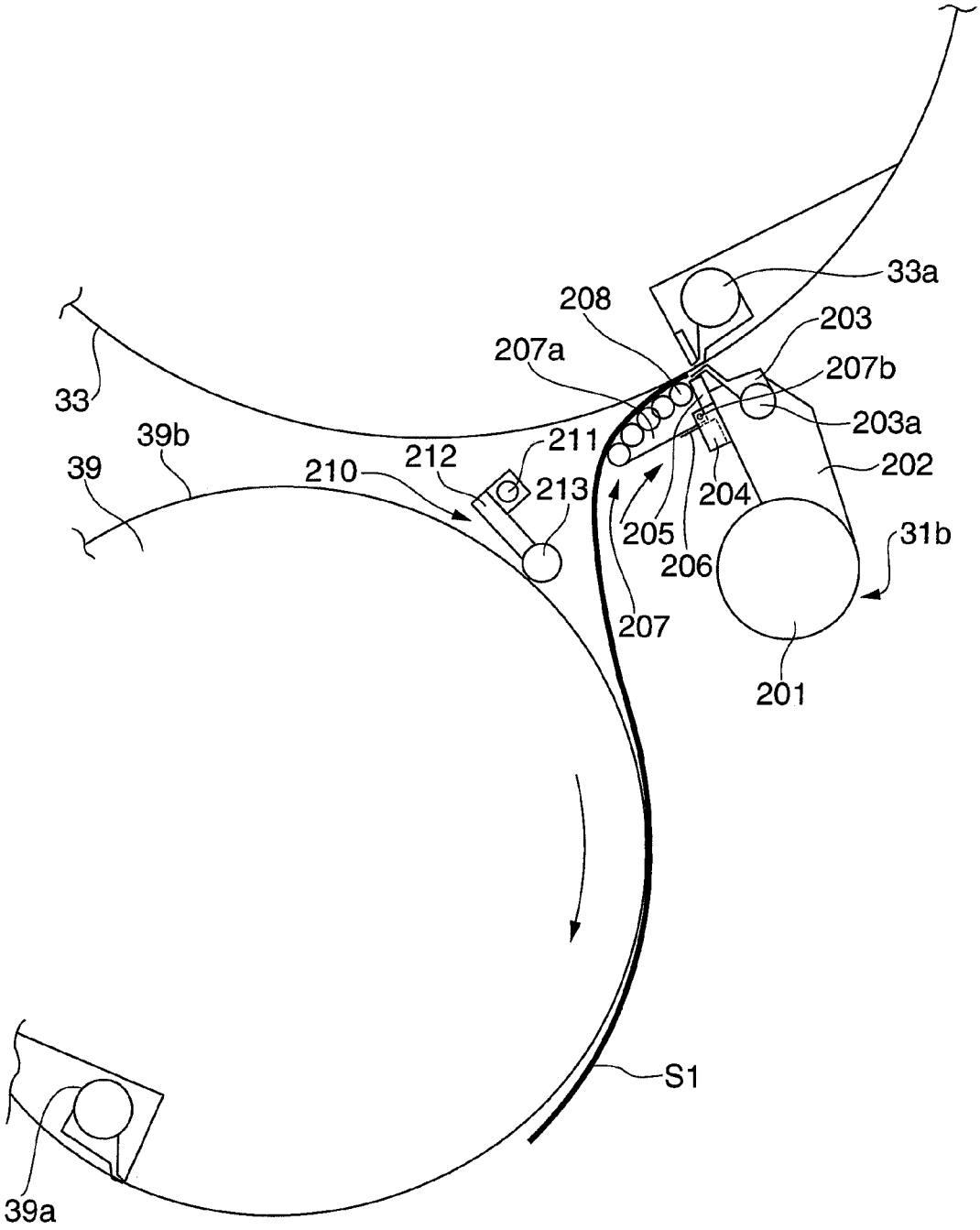
FIG. 5 is a sectional exploded view showing how the sheet is transferred onto a printing cylinder by the reversing swing arm shaft pregripper shown in FIG. 2.

After the sheet S1 is transferred by a griping change from the pre-reversal double-diameter cylinder 39 by the swing arm grippers 203 of the reversing swing arm shaft pregripper 31*b*, it is conveyed onto the printing cylinder 33 with its trailing edge leading as it swings from the reception position (a broken line in FIG. 3E) to the transfer position (a solid line in FIG. 3E) of the reversing swing arm shaft pregripper 31*b*, as shown in FIG. 5. The trailing edge of the turned sheet S1 is transferred by a griping change from the reversing gripper device 31*bt* of the reversing swing arm shaft pregripper 31*b* to any (the gripper device 33*a* in FIG. 5) of the gripper devices 33*a* to 33*c* of the printing cylinder 33.

In transferring the sheet S1 from the pre-reversal double-diameter cylinder 39 onto the printing cylinder 33, the sheet S1 is conveyed while being sequentially guided by the plurality of swing rollers 208 arranged in an arc, and is thus prevented from fluttering.

The sheet S1 transferred by a gripping change onto the printing cylinder 33 is conveyed with rotation of the printing cylinder 33. At this time, the sheet S1 is pressed against the circumferential surface of the printing cylinder 33 by the swing rollers 208 of the reversing swing arm shaft pregripper 31*b* positioned at the transfer position, and is thus prevented from fluttering and in tight contact with the circumferential surface of the printing cylinder 33.

The gripper devices 33*a* to 33*c* of the printing cylinder 33 alternately hold a new sheet S1 conveyed from the feed-side transfer cylinder 32. The reversing swing arm shaft pregripper 31*b* is positioned at the transfer position at the timing at which it is opposed to the printing cylinder gripper devices 33*a* to 33*c* which hold no new sheet S1, and the trailing edge of the sheet S1 is transferred from the reversing gripper device 31*bt* to the printing cylinder gripper devices 33*a* to 33*c*. With this operation, a new sheet S1 transferred from the feed-side transfer cylinder 32, and a turned sheet S1 transferred from the reversing gripper device 31*bt* of the reversing swing arm shaft pregripper 31*b* are alternately held by the printing cylinder gripper devices 33*a* to 33*c* of the printing cylinder 33, and are conveyed to the inkjet nozzle portion 34.

The trailing edge of the turned sheet S1 transferred from the reversing gripper device 31*bt* of the reversing swing arm shaft pregripper 31*b* is held and conveyed by the gripper devices 33*a* to 33*c* of the printing cylinder 33 while the surface (the obverse surface having undergone a digital printing process) of the sheet S1, which has already undergone a digital printing process by the inkjet nozzle portion 34, is in contact with the support surfaces 33*d*, 33*e*, and 33*f* of the printing cylinder 33, and the surface (the reverse surface having undergone no digital printing process) of the sheet S1, which has not yet undergone a digital printing process, is exposed. The inkjet nozzle portion 34 performs a digital printing process on the reverse surface of the sheet S1 conveyed in tight contact with the circumferential surface of the printing cylinder 33 in a turned state.

The control device (not shown) controls the inkjet nozzle heads 34*a* to 34*d* of the inkjet nozzle portion 34 to perform reverse printing on the turned sheet S1 transferred from the reversing gripper device 31*bt* of the reversing swing arm shaft pregripper 31*b*, and perform obverse printing on the new sheet S1 alternately held by the printing cylinder gripper devices 33*a* to 33*c* of the printing cylinder 33. With this operation, the inkjet nozzle heads 34*a* to 34*d* alternately perform obverse printing and reverse printing in correspondence with the new sheet S1 and turned sheet S1 alternately held by the printing cylinder 33.

The sheet S1 having undergone reverse printing on its reverse surface is discharged from the delivery belt 40 onto the pile board 41 sequentially through the delivery-side transfer cylinders 36 and 37, and delivery cylinder 38, as in the single-sided printing mode.

Other Embodiments

Note that in the above-mentioned embodiment, the present invention is applied to a digital printing press which performs a digital printing process on a sheet as a sheet processing apparatus. The present invention is not limited to this, and may be applied to a sheet processing apparatus which performs various processes including an offset printing process, inspection process, foil transfer process, and embossing process on a sheet.

Also, in the above-mentioned embodiment, a sheet trailing edge pressing member 207 having a swing roller is used as a pressing member. The present invention is not limited to this, and a belt-shaped pressing member may be used, the side surface of the holder may be in contact with the sheet, or a plate-shaped pressing member having a surface with a low frictional drag may be used.

Moreover, in the above-mentioned embodiment, the sheet is held by the gripper device portion of the pre-reversal double-diameter cylinder. The present invention is no limited to this, and the leading edge of the sheet may be held by a suction pad by suction, or the sheet may be punctured and held by a needle-shaped member.

What is claimed is:

1. A sheet reversing device comprising:

a first conveyance unit which includes a first holder that holds a leading edge of a sheet, and a support surface that supports the sheet conveyed by said first holder, and conveys the sheet with the leading edge thereof held by said first holder, and an entire surface thereof supported by said support surface;

a second conveyance unit which includes second holders that hold a trailing edge of the sheet, and conveys the sheet held by said second holders;

a third conveyance unit which is supported to be swingable between a reception position at which said third conveyance unit receives the sheet from said first conveyance unit, and a transfer position at which said third conveyance unit transfers the sheet to said second conveyance unit, said third conveyance unit including a third holder that holds the trailing edge of the sheet conveyed by said first conveyance unit, and conveying the sheet held by said third holder; and a sheet pressing member which is provided in said third conveyance unit, and presses the sheet conveyed by said first conveyance unit against said support surface of said first conveyance unit, said sheet pressing member comprising:

a holder which includes a proximal end supported by said third conveyance unit and a free end extending toward said first conveyance unit; and a plurality of rollers which are juxtaposed from said proximal end to said free end in an arc along a conveyance track of the sheet determined by a swing of said third conveyance unit and press the sheet to said support surface of said first conveyance unit.

2. A device according to claim 1, further comprising an upstream pressing member which is provided on an upstream side, in a sheet conveyance direction, of a position at which the sheet is pressed by said sheet pressing member, and presses the sheet against said support surface of said first conveyance unit.

3. A device according to claim 1, further comprising biasing means which biases said sheet pressing member in a direction in which the sheet is pressed against said support surface of said first conveyance unit.

* * * * *